US005966854A

United States Patent [19]

Walsh et al.

[11] Patent Number: 5,966,854

[45] Date of Patent: Oct. 19, 1999

[54] ROLL-UP INFORMATION DISPLAY

[76] Inventors: Robert M. Walsh, 812 Glen Garry, Flower Mound, Tex. 75028; Leo C. Squiers, 2500 Mustang #168, Grapevine, Tex. 76051

[21] Appl. No.: 08/902,143

[22] Filed: Jul. 29, 1997

[51] Int. Cl.[6] ..... G09F 11/21

[52] U.S. Cl. ..... 40/514; 40/515; 160/243

[58] Field of Search ..... 40/514, 515, 517; 160/296, 238, 243

[56] References Cited

U.S. PATENT DOCUMENTS

| | | | |
|---|---|---|---|
| 692,455 | 2/1902 | Kepler | 160/243 |
| 2,934,844 | 5/1960 | Bergier et al. | 40/661.03 X |
| 3,466,776 | 9/1969 | Paige | 160/238 X |
| 4,848,437 | 7/1989 | Laniado et al. | 160/238 |
| 4,929,751 | 5/1990 | Snyder, Jr. | 40/517 |
| 5,097,611 | 3/1992 | Smollar et al. | 40/514 |

*Primary Examiner*—Cassandra H. Davis
*Attorney, Agent, or Firm*—John E. Vandigriff

[57] ABSTRACT

An information and advertising display uses a self-coiling display media that can be mounted, for example, in the price strip on a shelf, or on a shopping cart. The display media is a plastic material that is self coiling, coiling from bottom to top of the display, so that the display media will roll itself up after being pulled down and then released. The display media is securely fastened to a mounting bracket at one end and is attached to a tube at the other end. A pull-down handle is loosely mounted in the tube so that the display media will coil around the tube when released.

11 Claims, 5 Drawing Sheets

ROLL-UP INFORMATION DISPLAY

FIELD OF THE INVENTION

This invention relates to roll-up information display devices, and more particularly to an information display that utilizes a self roll-up display media.

BACKGROUND OF THE INVENTION

Roll-up display signs have been utilized in a number of configurations where the display media is mounted on a roller device that includes a spring to cause the display media to roll around a cylinder or tubular mount. For example, in U.S. Pat. No. 4,292,752, a display is mounted on a spring biased roller and is held in an open or rolled down position by a clip attached around a bracket. Because of the spring biased roller, the display media will roll-up when the hold down clip is release from the bracket.

A similar device is described in U.S. Pat. No. 2,351,822, in which a display device is mounted on a cylindrically shaped rod that is mounted by and biased with an elastic band. When the display is pulled downward, unrolling the display, the elastic band is twisted. When the display is released, the twisted elastic band will cause the display to wind up around the cylindrically shaped rod.

Other display devices are found in the prior art, but most utilize a spring biased roller to roll the display media up when released. Examples of these are found in U.S. Pat. Nos. 3,466,776, 4,825,571, 4,525,9461, 284,828 and 534, 963.

SUMMARY OF THE INVENTION

The invention is a pull-down display that can be mounted, for example, in the price strip on a shelf, or on a shopping cart. The display media is a plastic material that is self coiling so that the display media will roll itself up after being pulled down and then released. The display media is securely fastened to a mounting bracket at one end and is attached to a tube at the other end. A pull-down handle is loosely mounted in the tube so that the display media will coil around the tube when released.

DESCRIPTION OF A PREFERRED EMBODIMENT

Figure 1:
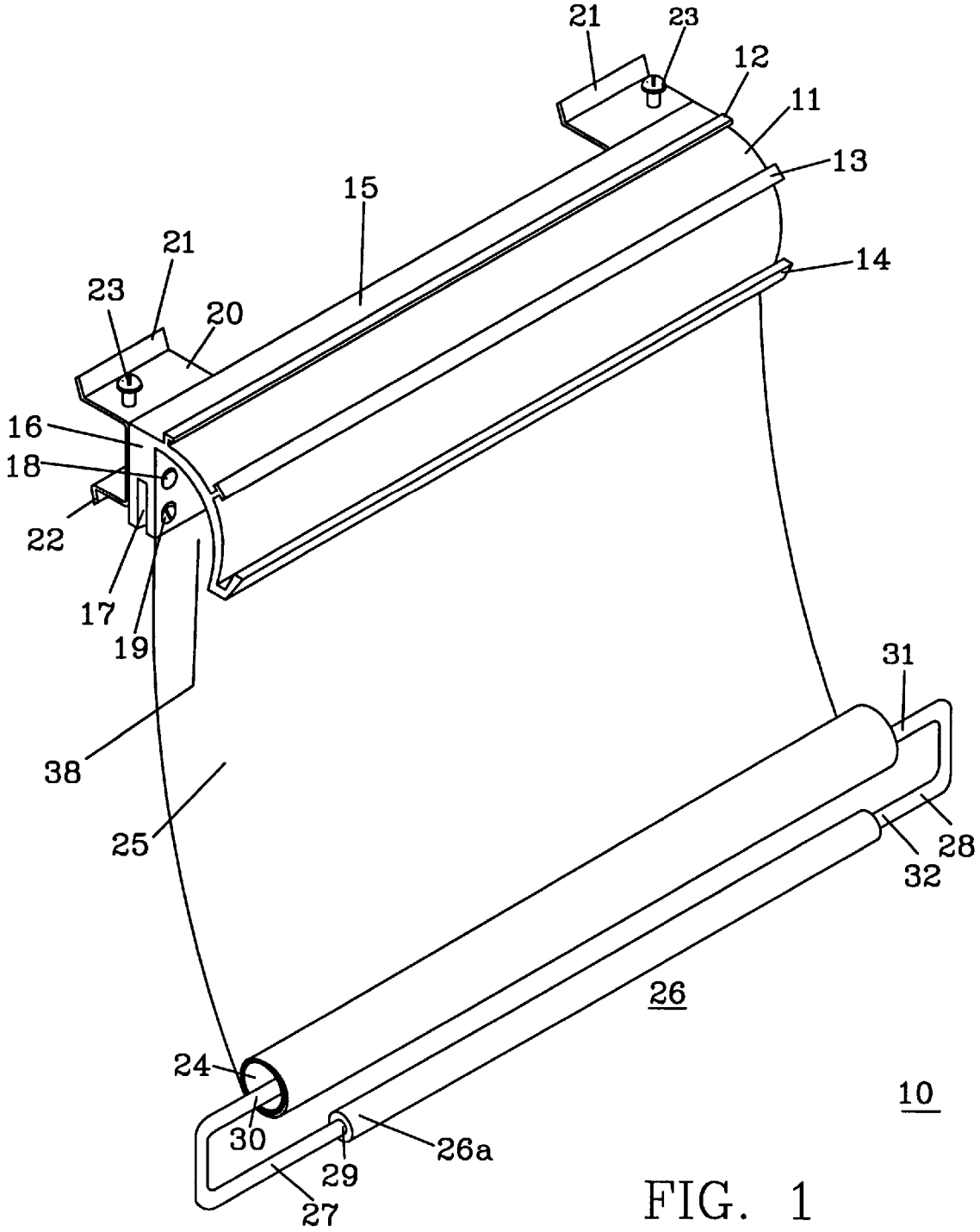
FIG. 1 shows the roll-up display device of the invention in a pulled-down position.

FIG. 1 shows the display device 10 of the present invention in an extended or pulled-down position. Display device 10 has a frame 15 which has a curved of semicircular cover 11 reenforced by ribs 12, 13 and 14. Ribs 12, 13 and 14 may also be used to hold notices or product information. Such information is placed on cards that may be placed between two ribs and held in place by the ribs. For example, a notice is placed between rigs 13 and 14 indicating that a map of the store showing the location of products is on the roll-down display.

Frame 15 also has a channeled part 16 which includes a channel 17 into which one end of self-coiling display media 25 is inserted and held in place by screw 19. A second screw 19 is on the opposite end of channel 17, but is not illustrated in FIG. 1. Display media 25 is a self-coiling material, for example, polyvinyl chloride (PVC). While the material thickness is not critical, it may be in a range including 10 mils thick.

Frame 15 may have various mounting devices such as brackets 20. There is one bracket 20 on each end of frame 15. In the embodiment shown, each bracket 15 has a bent-up edge 21 and a bent-down edge 22. Each bracket 20 is secured to frame 15 by at least one screw or rivet 18. Only one rivet 18 is shown in FIG. 1, but at least one other screw 18 holds bracket 20 on the right side of frame 15. Brackets 20 mount display 10 on a shelf as shown below with reference to FIG. 5.

Display media 25 is a plastic material that is self-coiling material so that it is rolled-up in its normal state. Display media 25 is attached to frame 15 in slot or channel 17 on one end and is attached to a tube 24 on its other end. It may be attached with an adhesive or may be attached with brads or rivets. A handle 26 is movably mounted in tube 24 by two brackets 27 and 28. Bracket 27 has an end mounted in a channel 26*b* (FIG. 4) in handle tube 26*a,* and another end 30 extends into the open end of tube 24. Similarly, a second bracket 28 has one end mounted in handle tube 26*a* and another end in tube 24. Both bracket ends 30 and 31 extend loosely into tube 24 and are not physically attached to tube 24. When a person pulls downward on handle 26, display media 25 will roll out or unwind from around tube 24 as shown in FIG. 1. When handle 26 is released, display media 25 will coil itself around tube 24 and move into the semicircular space 38 in frame 15.

Figure 2:
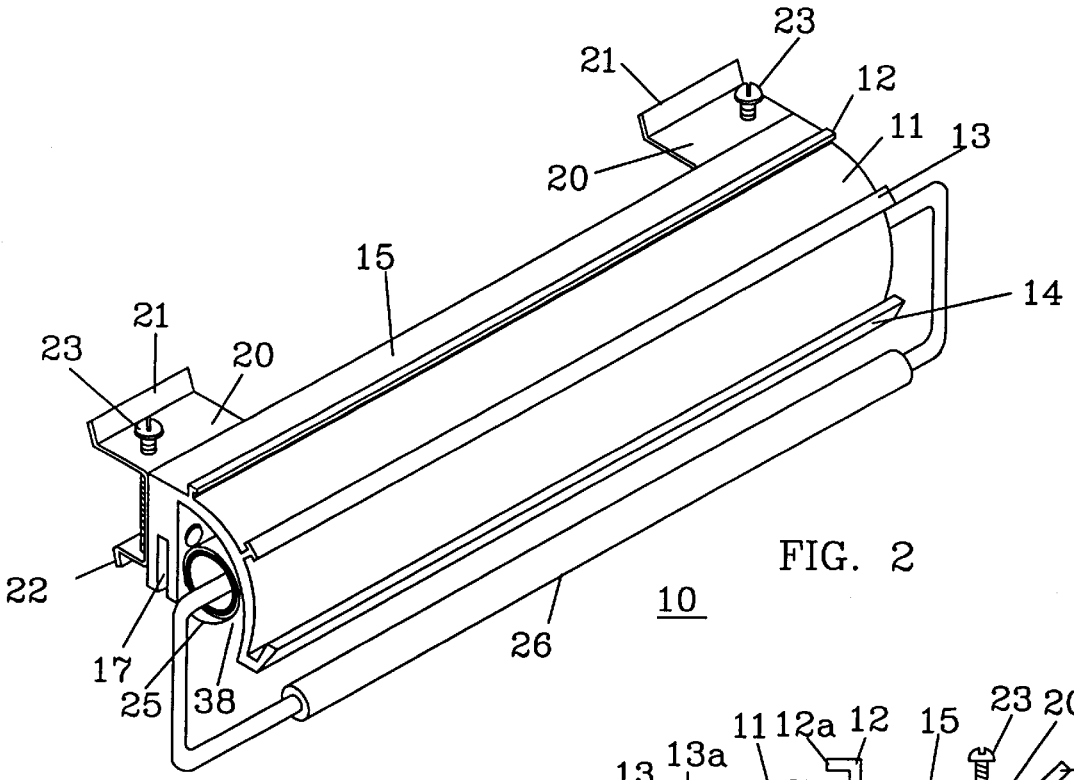
FIG. 2 shows the roll-up display device with the display media coiled-up in the mounting bracket.

FIG. 2 shows display device 10 with media 25 rolled-up or coiled into the storage position in semicircular area 38. When media 25 is rolled into a coil, it is pulled down by pulling on handle 26. Since media 25 is a self-coiling material, it will remain in the stored position, as shown, until it is pulled down and out of the semicircular area 38.

Figure 3:
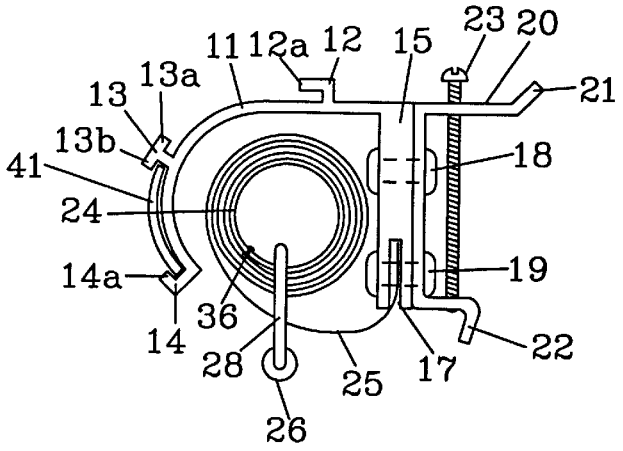
FIG. 3 is an end view of the display device.

FIG. 3 is a end view of display device 10 with media coiled up into area 38 Media 25 is attached in slot 17 of frame 15 by rivet or screw 19. There is at least one rivet 19 on each end of frame 15 so that media 25 is secured to at least two points in slot 17. Media 25 is attached to tube 24 by any suitable means such as glueing, taping or a fastener, such as fastener 36. There may be several fasteners along the edge of media 25 where it is fastened to tube 24. Handle 26 is suspended from tube 24 by brackets 28 and 27 (FIG. 1) Screw or rivets 18 attached bracket 20 to frame 15.

Cover 11 has ribs 12–14 that are used to reenforce cover 11 and each rib 12–14 has an extended end. For example rib 12 has extended end 12*a,* rib 13 has extended ends 13*a* and 13*b,* and rib 14 has extended end 14*a.* Display cards may be inserted in the space between the ribs 12–14 and held in place by the extended ends. For example a card 41 is between ribs 13 and 14 and held in place by ends 13*b* and 14*a.*

Figure 4:
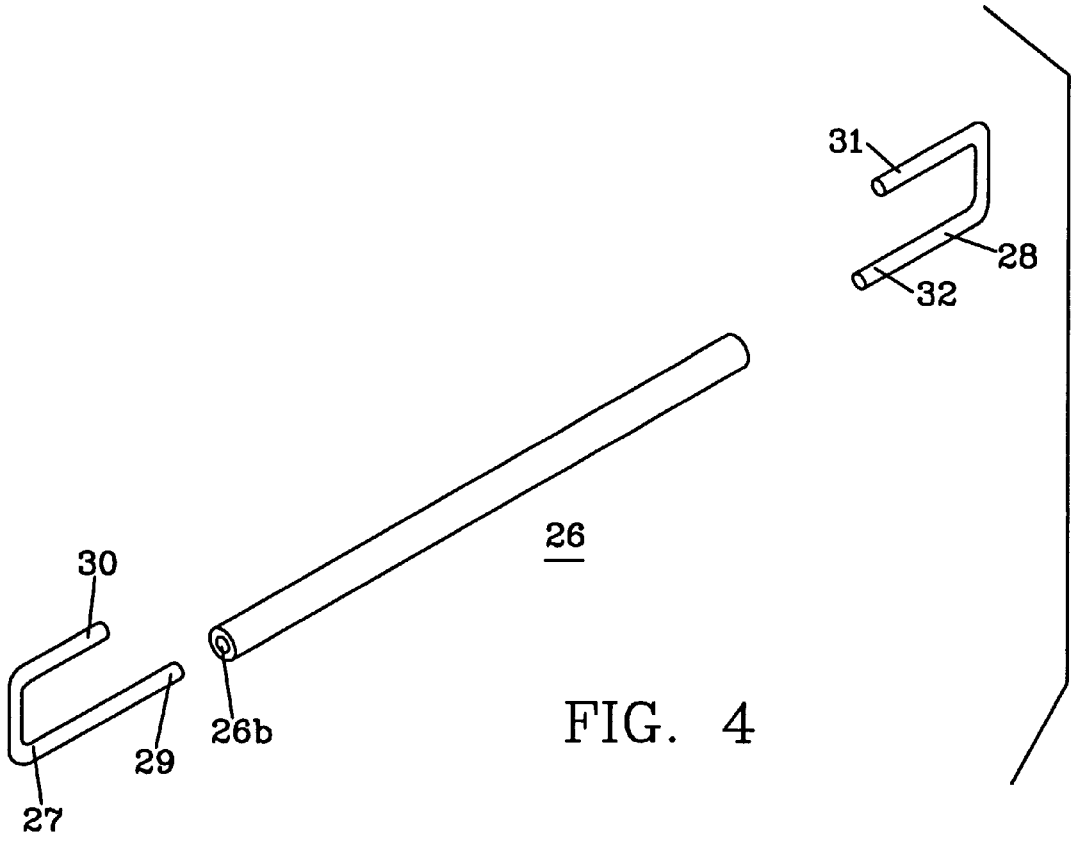
FIG. 4 shows the pull-down handle.

FIG. 4 is an exploded view of handle 26 and brackets 27 and 28. Handle 26 is a hollow tube, at least on each end. A first bracket 27 has an end 29 that is inserted into opening 26*b.* A second bracket 28 has an end 32 that is inserted into tube 26. Bracket ends 30 and 31 are inserted into the ends of tube 24 to which display media 25 is attached. Bracket ends 30 and 31 are loosely inserted into tube 24 so that media 25 can coil itself around tube 24 and handle 26 will remain in the downward suspended position as shown in FIGS. 1–3.

Figure 5:
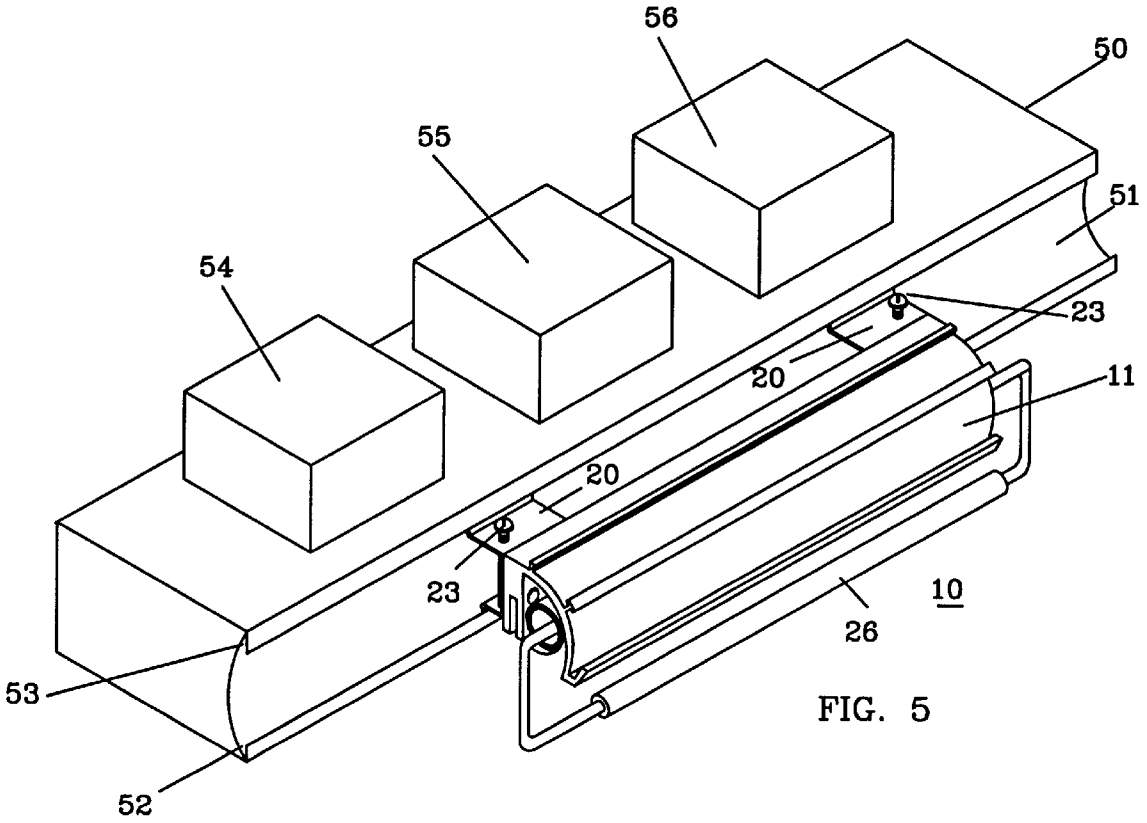
FIG. 5 shows the roll-up display device mounted in the price tag strip on a display shelf.

FIG. 5 shows the mounting of a display device 10 on a shelf 50. Shelf 50 has an area 51 where price tags and other information are attached to the shelf 50. Area 51 is concave with edges 52 and 53 extending inward from its respective edge so as to hold a display card. Display device 10 has two brackets 20 with angled edges 21 and 22. Edge 21 extends upward and is placed in shelf edge 53, and bracket edge 22 extends downward and is placed in shelf edge 52. Screw 23 is then used to move bracket edges 21 and 22 away from each other to secure the brackets 20 in shelf display area 51. Products 54–56 are shown on shelf 50, and display device 25 may describe the products and show pricing information.

Figure 6:
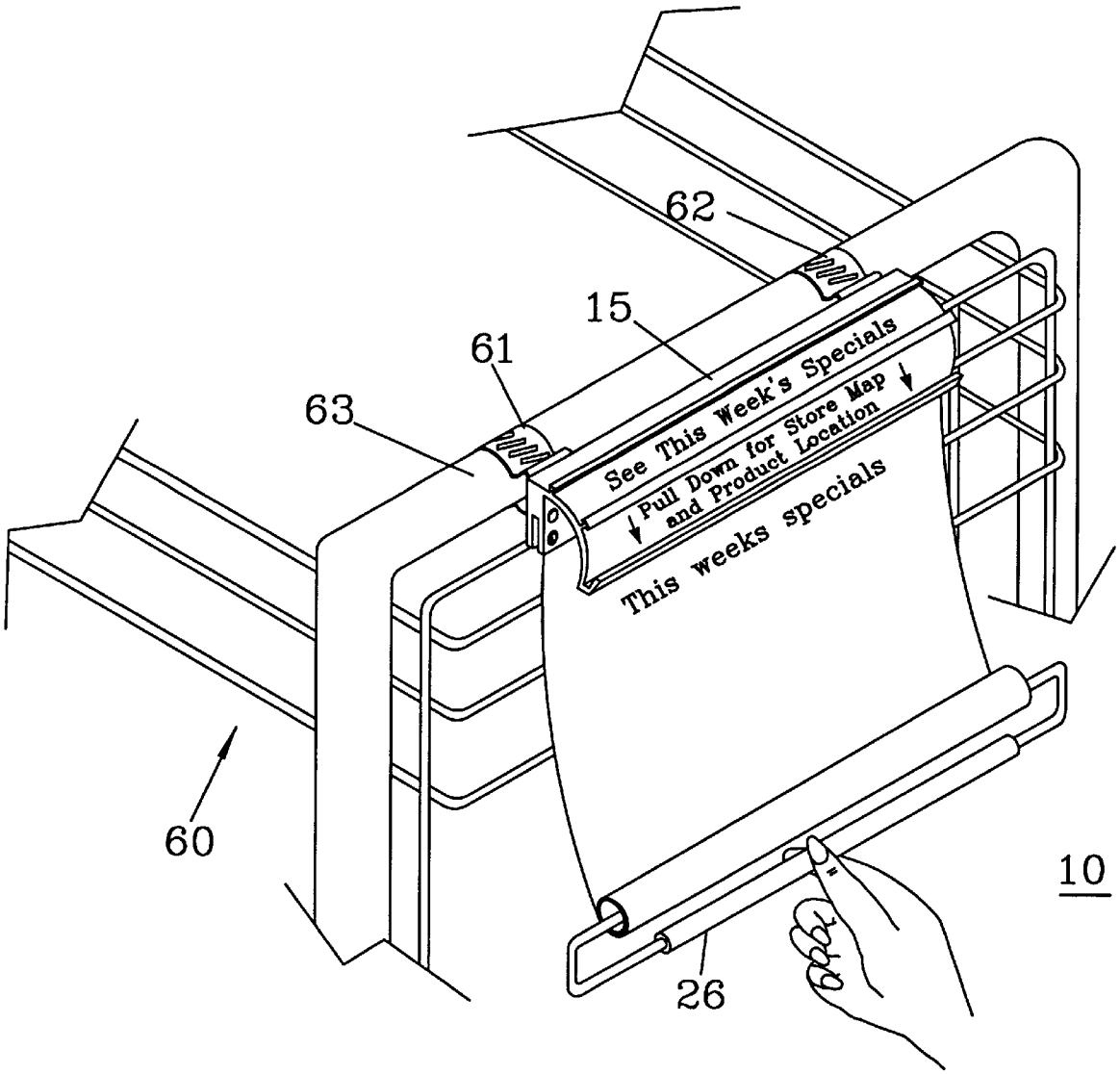
FIG. 6 shows the roll-up display device mounted on a shopping cart.

FIG. 6 shows display device 10 attached to a shopping cart 60. Clips 61 and 62, attached to frame 15, hold display device 10 to cart rail 63. A shopper can pull down display device 10 with handle 26 and see a map of the store showing product locations, and product specials of the week.

In use, the display media may have printed information thereon, or information may be applied to the media by using removable adhesive labels, or the media may be written on by erasable ink and pencil.

What is claimed:

1. A roll-up display device, comprising:

a mounting frame with a slot therein;

a cover attached to said mounting frame:

a self-coiling display sheet rigidly attached by a first end to said frame in said slot under said cover, and attached at a second end to a tube; and a handle suspended from a tub of said display sheet for pulling said display sheet to an extended uncoiled position;

wherein when said self-coiling sheet is in an extend position, and the handle is released, the self-coiling sheet will coil itself upward and around said tube.

2. The display device according to claim 1, including at least one bracket for attaching said display device to an object.

3. The display device according to claim 1, wherein said a portion of said handle is inserted into and movably suspended from said tube.

4. The display device according to claim 1, wherein said handle includes a tubular handle and two brackets, one attached to each end of said tubular handle.

5. The display device according to claim 1, wherein said cover has ribs thereon between which information tags may be mounted.

6. The display device according to claim 1, wherein said display sheet is a self-coiling plastic material.

7. A roll-up display device, comprising:

a mounting frame with a slot therein;

a ribbed cover attached to said mounting frame:

a self-coiling display sheet rigidly attached by a first end to said frame in said slot and positioned under said cover, and a second end of said self-coiling display sheet is rolled and secured to itself to form a tube; and a handle suspended from said second end of said display sheet for pulling said display sheet to an extended uncoiled position.

8. The display device according to claim 7, including at least one bracket for attaching said display device to an object.

9. The display device according to claim 7, wherein said handle includes a tubular handle and two brackets, one bracket attached to each end of said tubular handle and extending into said tube.

10. The display device according to claim 7, wherein the ribs on said ribbed cover provide a mounting area between the ribs on which information tags may be mounted.

11. The display device according to claim 7, wherein said display sheet is a self-coiling plastic material.

* * * * *